United States Patent [19]

Iizuka et al.

[11] Patent Number: 4,828,666

[45] Date of Patent: May 9, 1989

[54] ELECTRODE FOR FLOW-THROUGH TYPE ELECTROLYTIC CELL

[75] Inventors: Yasuhiro Iizuka; Makoto Inoue; Takeshi Mitomi, all of Ohtsu, Japan

[73] Assignee: Toyo Boseki Kabushiki Kaisha (trading under Toyo Co., Ltd.), Osaka, Japan

[21] Appl. No.: 155,730

[22] Filed: Feb. 16, 1988

[30] Foreign Application Priority Data

Feb. 16, 1987 [JP] Japan ..... 62-33033

[51] Int. Cl.[4] ..... C25B 11/03; C25B 11/12

[52] U.S. Cl. ..... 204/255; 204/283; 204/284; 204/290 R; 204/294

[58] Field of Search ..... 204/255, 283, 294, 284, 204/254, 290 R

[56] References Cited

U.S. PATENT DOCUMENTS

| | | | |
|---|---|---|---|
| 4,273,629 | 6/1981 | Korach | 204/254 X |
| 4,308,122 | 12/1981 | DasGupta et al. | 204/284 X |
| 4,445,990 | 5/1984 | Kim et al. | 204/294 X |
| 4,647,359 | 3/1987 | Lindstrom | 204/294 |

FOREIGN PATENT DOCUMENTS

| | | | |
|---|---|---|---|
| 0026995 | 4/1981 | European Pat. Off. | 204/294 |
| 0711175 | 1/1980 | U.S.S.R. | 204/294 |

OTHER PUBLICATIONS

Research Disclosure, May 1978, No. 16950.

*Primary Examiner*—Donald R. Valentine
*Attorney, Agent, or Firm*—Wegner & Bretschneider

[57] ABSTRACT

An electrode for a flow-through type electrolytic cell which comprises:

a frame spacer formed with a plate made of an insulating material and textile fabric made of carbon fibers disposed in the inner space of the spacer;

said spacer and said textile fabric being held between a membrane and a collector plate so that an reactant flows through the inside the texture of the above textile fabric in one direction or in the reverse direction;

said textile fabric being composed of thicker yarns of not finer than 5 metric counts and yarns finer than said thicker yarns which are disposed so as to cross said thicker yarns; and said textile fabric being fixed so that the thicker yarns are substantially in parallel with the flow direction of an aqueous solution of an reactant.

3 Claims, 2 Drawing Sheets

FIG. 1
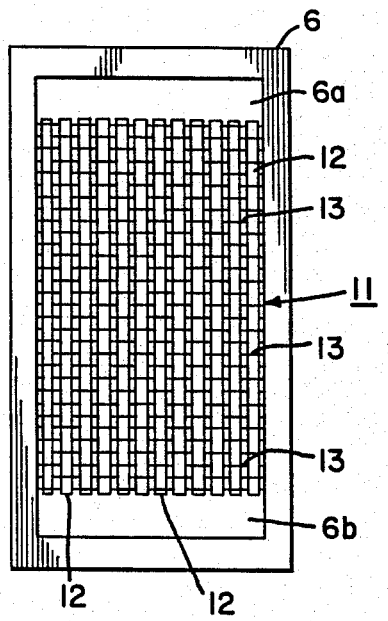
FIG. 2
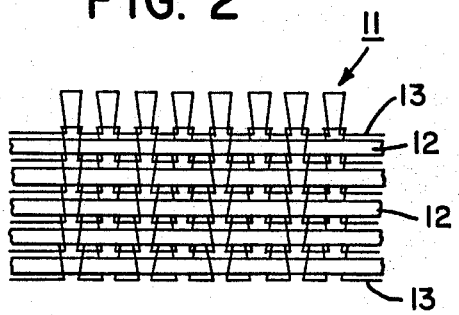
FIG. 3
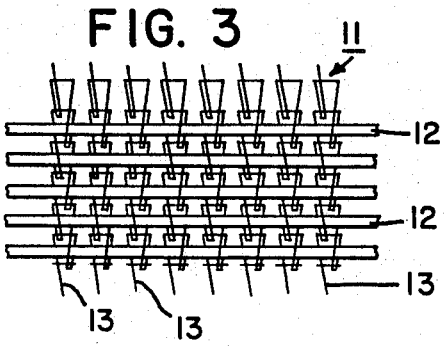
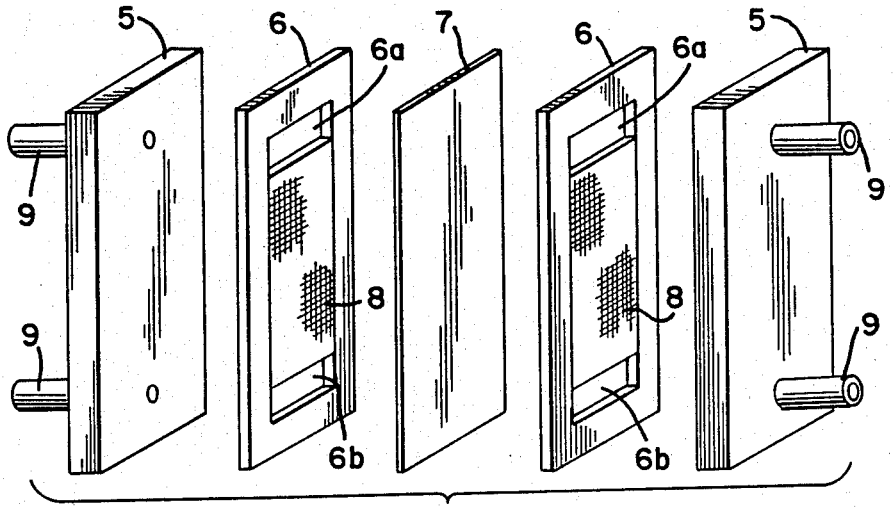
FIG. 4 PRIOR ART

PRIOR ART
FIG. 5a
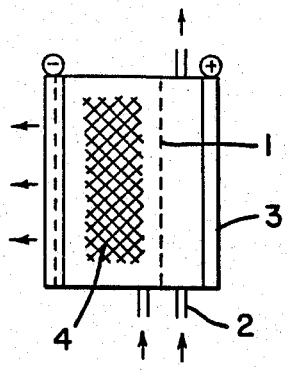
PRIOR ART
FIG. 5b
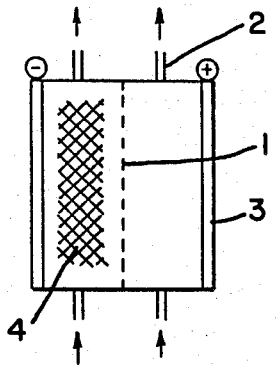
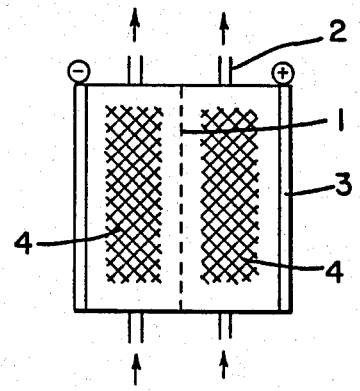
FIG. 5c
PRIOR ART

ELECTRODE FOR FLOW-THROUGH TYPE ELECTROLYTIC CELL

FIELD OF THE INVENTION

The present invention relates to an electrode for a flow-through type electrolytic cell comprising textile fabric made of carbon fibers.

BACKGROUND OF THE INVENTION

A redox-flow type battery is known as that for coping with the change of demand of electric power by storing excess electric power in the nighttime and supplying it according to increase in demand in the daytime. In this redox-flow type battery, electrochemical energy conversion is carried out in the cells of the battery system supplying active materials from the outside. The electrochemical reaction at this time is ordinarily a heterogenous reaction occurring on the surface of an electrode, and the electrochemical reaction field is generally two-dimensional. Therefore, the old redox-flow type battery had such a defect that the reaction density per unit volume of an electrolytic cell was small.

Then, in order to increase the reaction density per unit volume, that is, the current density, three-dimensionalization of the electrochemical reaction field has been practiced and textile fabrics such as nonwoven fabrics or woven fabrics of carbon fibers are used as an electrode thereof.

Typical examples of flow-through type electrolytic cell having a three-dimensional electrode are schematically shown in the accompanying FIGS. 5 (*a*), (*b*) and (*c*). The cell comprises a membrane 1, flow paths of an solution of an active material 2, collectors 3 and a three-dimensional electrode 4 of nonwoven cloths, woven cloths or the like made of carbon fibers. For example, tanks of the solution of the active material are disposed upper and lower side and right and left side of the cell shown in these drawings, respectively. In the nighttime, the solution of the active material flows from the lower tank to the upper tank as shown by the arrows and the solution passes through the texture of the three dimensional electrode 4 to effect the electrochemical reaction to charge with electricity. In the daytime, the solution flows in the reverse direction to supply electricity.

In Japanese Patent Kokai No. 59-119680, there is disclosed a flow-through type electrolytic cell having a three-dimensional electrode of knitted fabrics of carbon fibers as shown in the accompanying FIG. 4. The cell comprises collectors 5, frame type spacers 6 formed by thin insulating plates and a membrane 7 such as an ion exchange membrane, a porous membrane or the like. In the inner space of the spacer 6, there is provided a three-dimensional electrode 8 comprising warp knitted fabric of carbon fibers in rib stitch, pearl stitch, tuck stitch, float stitch, interlock stitch or the like and weft knitted fabric of carbon fibers in two needle stitch, perlin stitch, double denbigh stitch, double half stitch, back half stitch and the like so that gaps 6*a* and 6*b* are formed at both upper and lower parts of the electrode. The spacers 6 and the collectors 5 are overlaid on both sides of the membrane 7 and flow paths 9 for an solution of an active material are fixed on both upper and lower parts of the collectors 5 so that the openings thereof communicates to the gaps 6*a* and 6*b*, respectively. The solution of the active material flows in the upper or lower direction through the texture of the three-dimensional electrode 8.

The warp knitted fabric and weft knitted used in the above three-dimensional electrode 8 are obtained by interweaving knitted cloths using yarns of man-made or synthetic fibers such as regenerated cellulose fibers and the like and then carbonizing them. However, since the above knitted cloths are interwoven with one kind of yarns, their textures are relatively fine such as rib stitch, double denbigh stitch and the like as described above. Thus, all yarns bend in the same way to form loops, go back and forth in the thickness direction, and tangles with each other, which forms small concavo-convex parts all over the surface almost uniformy and complicatedly bending voids in the texture. For these reasons, when the solution of the active material flows, pressure drop becomes great. Therefore, a large amount of energy is required for pumping the solution, which results in decrease in total energy efficiency of a battery. By the way, use of unwoven cloth for the three-dimensional electrode 8 is also known. However, in this case, since fibers cross with each other at points and contact area between fibers is small, there is a problem that electric resistance as an aggregate becomes larger and also cycle change of resistance with time is liable to become larger. On the other hand, when woven cloth of the above yarns is used, there is a problem that crossing and contacting area of yarns become too large and a larger reaction field is not expected in spite of requiring much yarns. Further, since an aqueous solution of an active material can not pass through the inside the texture but pass over the surface and the back surface of the woven cloth, the inside of the texture can not be worked as the reaction field.

OBJECTS OF THE INVENTION

The main object of the present invention is to improve total energy efficiency of an electrolytic cell by decreasing pressure drop through electrode and decreasing power loss by pumping up the solution by improving texture structure in textile fabric of carbon fiber yarns used for the electrode.

This object as well as other objects and advantages of the present invention will become apparent to those skilled in the art from the following description with reference to the accompanying drawing.

BRIEF EXPLANATION OF DRAWING

FIG. 1 is a front view of one of preferred embodiment of the electrode of the present invention.

FIGS. 2 and 3 are schematic views showing examples of texture of textile fabrics used for the electrode of the present invention.

FIG. 4 is a perspective view of the flow-through type electrolytic cell of Japanese Patent Kokai No. 59-119680 as described above wherein each part is broken up.

FIGS. 5 (*a*), (*b*) and (*c*) are schematic views of known liquid-flow type electrolytic cells, respectively.

SUMMARY OF THE INVENTION

According to the present invention, there is provided an electrode for a flow-through type electrolytic cell which comprises:

a frame spacer formed with a plate made of an insulating material and textile fabric made of carbon fibers disposed in the inner space of the spacer;

said spacer and said textile fabric being held between a membrane and a collector plate so that an electrolytic solution flows through the inside the texture of the above textile fabric in one direction or in the reverse direction;

said textile fabric being composed of thicker yarns of not finer than 5 metric counts and yarns finer than said thicker yarns which are disposed so as to cross said thicker yarns; and said textile fabric being fixed so that the thicker yarns are substantially in parallel with the flow direction of an solution of an active material.

Since, in the present invention, the thicker yarns are disposed in parallel with the flow direction of an aqueous solution of an active material in the three-dimensional electrode using textile fabric made of carbon fibers, the electrode of the present invention has equal or better electrochemical properties in comparison with a conventional three-dimensional electrode made of nonwoven cloth or textile fabric. In addition, upon flowing an solution of an active material, pressure drop is remarkably decreased, for example, to one-several tenths and, therefore, the total energy efficiency is improved by several percent to several tens percent. Further, by laminating a plurality of the above textile fabric of carbon fibers-spacer-collector and membrane, output can be increased as a conventional electrode.

DETAILED DESCRIPTION OF THE INVENTION

As shown in FIGS. 1 to 3, in the present invention, textile fabric 11 is used instead of the electrode 8 made of knitted cloth as shown in the above FIG. 4. That is, the present invention is characterized in that this textile fabric 11 is knitted or woven with carbon fiber yarns and is composed of thicker yarns 12 of not finer than 5 metric counts and yarns 13 finer than the thicker yarn which are disposed in the direction so as to cross the thicker yarns, and the thicker yarns 12 is fixed substantially in parallel with the flow direction of an aqueous solution of an active material. When the direction of the thicker yarns are not substantially in parallel with the flow direction, the effective electrode width is decreased and thereby pressure loss is increased. Further, stagnation of an electrolytic solution is caused and hydrogen gas is liable to generate by side reaction at charging. Thus, the thicker yarns should be substantially in parallel with the flow direction of an solution of an active material. In FIG. 1, there is shown reed screen-like woven cloth 11. The texture of the woven cloth may be twill weave, satin weave or leno weave. Or, as shown in FIG. 2, weft knitted cloth with weft yarns wherein thicker yarns 12 are inserted as weft yarns in every course, when interweaving finer yarns 13 into weft knitted cloth. Or, as shown in FIG. 3, warp knitted cloth with weft yarns wherein thicker yarns 12 are inserted as weft yarns in every course when interweaving a plurality of finer yarns 13 into a plurality of chain stitches. In these cases, weft yarns (thicker yarns 12) are fixed in the flow direction in the electrolytic cell. Although fixing can be effected by any means, it is convenient to fix the textile fabric by heat bonding it onto a bipolar plate made of conductive plastics.

By directing the thicker yarns 12 of not finer than 5 metric counts toward the flow direction of an aqueous solution of an active material, thickness of the electrode can be increased and slit-like paths between adjacent thicker yarns 12 can be formed which results in lowering of pressure drop. In addition, since the finer yarns 13 cross the thicker yarns 12 at right angle, better electric contact between carbon fibers of these yarns 12 and 13 is obtained, which results in lowering of internal resistance of a battery.

Textile fabric 11 used in the present invention can be obtained by interweaving textile fabric having the above texture using carbonizable raw fibers, for example, pitch obtained from coals or oils, spun yarns or filament bundling yarns prepared from fibers such as phenol, acryl, aromatic polyamide or cellulosic fibers and then carbonizing it. Alternatively, textile fabric 11 can be obtained by interweaving carbonized yarns. In these cases, thickness of fibers are preferably 0.5 to 15 denier. When thickness is less than 0.5 denier, pressure drop increases. When thickness is greater than 15 denier, total fiber surface area is insufficient when fibers are converted into a yarn having a prescribed thickness, and strength is insufficient. Thickness of thicker yarns 12 before carbonization is determined by reverse operation from carbonization yield and contraction ratio of raw fibers as well as those in subsequent steps so that thickness upon use becomes not finer than 5 metric counts, preferably, 0.1 to 3.0 metric counts. And, thickness and density of finer yarns 13 are set so that the above slit-like path can be formed. In addition, a preferred weight after interweaving is 100 to 1000 g/m$^2$, although it is varied depending upon the thickness of the spacer.

Carbonization treatment can be carried out by a conventional method. However, it is preferable that textile fabric interwoven, yarns or filament bundling yarns are subjected to a flame resistant treatment, if necessary, and then heat treatment is carried out at a temperature of not less than 500° C., preferably, not less than 1000° C. to effect carbonization. This carbonization treatment gives carbon fibers having quasi-graphite microcrystalline structure of not more than 3.70 Åof average <002> spacing ($d_{002}$) measured by a X-ray wide angle scattering analysis. And, when textile fabric 11 made of the carbon fibers is used as an electrode, the amount of hydrogen generation at the cathode during charge is inhibited and current efficiency is remarkably improved. In addition, when dry oxidation treatment is effected after the carbonization treatment by further heating to a temperature higher than 400° C. in an oxygen atmosphere wherein oxygen partial pressure is greater than $1\times10^{-2}$ torr in such a degree that the weight yield becomes 65 to 99%, more edges of planes vertical to C axes of the above quasi-graphite microcrystals can be exposed to the fiber surface and, at the same time, oxygen atoms effective in the electrochemical reaction can be formed on these edges. Therefore, the ratio of the number of bonded oxygen atoms to that of carbon atoms on the fiber surface (O/C ratio) measured by ESCA surface analysis method becomes not less than 3% and the electrode reaction rate, that is, the cell conductivity is improved remarkably. Further, the textile fabric 11 may contain 0.01 to 50% by weight of boron by adding a boron compound such as boric acid, borate, triethyl borate, tributyl borate, tripropyl borate, triphenyl borate or the like to the above textile fabric, yarns or filament bundling yarns before carbonization, or adding the boron compound to textile fabric, yarns or filament bundling yarns after low temperature carbonization and then treating at a higher temperature. In this case, decrease in voltage efficiency with time can be prevented even when repeating charging and discharging of a battery.

The <002> spacing, O/C ratio, cell current efficiency, cell conductivity and pressure drop used herein are measured as follows.

(a) <002> spacing ($d_{002}$)

Yarns or textile fabric of carbon fibers are powdered in an agate mortar and 5 to 10% by weight of high purity silicon powder for X-ray standard is admixed as an internal standard. The mixture is packed into a sample cell and a wide angle X-ray diffraction curve is measured by transmission diffractometer method using CuK$\alpha$-ray as a source of radiation. No amendment with regard to so-called Lorentz factor, polarization factor, absorption factor, atomic scattering factor and the like is made in calibration of the curve and the following simple method is employed. That is, the base line for a peak corresponding to <002> diffraction is drawn, essential intensity intensity the base line is replotted to obtained an calibration <002> intensity curve. A middle point of a segment formed by crossing of the above calibration intensity curve and a straight line parallel with the angle axis drawn at two-third height of the peak of the curve is obtained, an angle corresponding to the middle point is corrected with to the internal standard. This angle is used as 2-fold of the diffraction angle, and <002> spacing $d_{002}$ is calculated from the diffraction angle and the wave length ($\lambda$) of CuK$\alpha$-ray using the following Bragg's equation:

$$d_{002} = \frac{\lambda}{(2 \sin \theta)}$$

(wherein, $\lambda$: 1.5418 Å, $\theta$: angle of diffraction)

(b) O/C ratio

O/C ratio is measured by X-ray photoelectric spectrometry method abbreviated as ESCA or XPS. This measurement is carried out by using ESCA 750 (manufactured by Shimazu Seisakusho, Japan) and analysis is carried out by using ESCAPAC 760 (manufactured by Shimazu Seisakusho, Japan).

Each sample is punched out into a disk of 6 mm in diameter and mounted on a specimen carrier having a heater with double-adhesive-coated tape to analyze provided that the sample has been heated to 120° C. and degased under vacuum for more than 3 hours before the measurement. MgK$\alpha$-ray (1253.6 eV) was used as a source or radiation and degree of vacuum in the apparatus is set at $10^{-7}$ torr. The measurement is carried out to Cls and Ols peaks, each peak is analyzed using ESCAPAC 760 (based on amending method by J. H. Scofield) to obtain each peak area. The resulting area is that multiplied by 1.00 of relative intensity in the case of Cls or by 2.85 is the case of Ols, from which the ratio of numbers of surface (oxygen/carbon) atoms is directly calculated by %.

(c) Cell current efficiency

As shown in FIG. 4, a small size flow-through type electrolytic cell having 10 $cm^2$ of effective electrode area, 10 cm of longitudinal length (liquid flow direction) and 1 cm of width is manufactured and charging and discharging are repeated at a constant current density to test for electrode performance. For the anode, each 1M/liter aqueous solution of ferrous chloride and ferric chloride mixture, acidified with 4N hydrochloric acid is used. 1M/liter aqueous solution of chromic chloride acidified with 4N hydrochloric acid is prepared as negative reactant. The solution for the anode is used in large excess relative to that for the cathode so that cathode properties can be mainly tested. The liquid flow rate is set at 4.5 ml per min. and the current density is set at 40 $mA/cm^2$. In a test of one cycle which starts at charging and finishes at discharging, the current efficiency is determined by the following equation in which $Q_1$ (Coulomb) represents the quantity of electricity required for charging, $Q_2$ (Coulomb) represents the taken out quantity of electricity for constant current discharging to 0.2 V, and $Q_3$ (Coulomb) represents the taken out quantity of electricity for subsequent constant potential discharging at 0.8 V.

$$\text{Current efficiency} = \frac{Q_2 + Q_3}{Q_1} \times 100(\%)$$

When a reaction other than reduction of $Cr^{3+}$ to $Cr^{2+}$, for example, a side reaction such as reduction of $H^+$ or the like occurs, the quantity of electricity which can be taken out is decreased and thereby current efficiency is decreased.

(d) Cell conductivity

The charging rate is calculated by the following equation in which Qth represents the theoretical quantity of electricity required to reduce $Cr^{3+}$ to $Cr^{2+}$ thoroughly in the cathode solution, $Q_2$ represents the quantity of electricity to be taken out during discharging.

$$\text{Depth of charge} = \frac{Q_2}{Qth} \times 100(\%)$$

Cell resistance ($\Omega cm^2$) and its reciprocal number or cell conductivity (S $cm^{-2}$), are determined from the slope of a current-voltage curve at the point of 50% of depth of charge. As the cell conductivity becomes larger, an oxidation-reduction reaction of ions at electrode proceeds faster and discharging potential at a high current density becomes higher. Thus, such a cell is evaluated as an excellent electrode. The above tests for cell current efficiency and cell conductivity are carried out at 40° C.

(e) Pressure drop

The path 9 of an aqueous solution of an active material for both anode and cathode in the battery shown in FIG. 4 is equipped with a mercury manometer. An aqueous solution of an active material is flown at the rate of 4.5 ml per min. and pressure drop through on the electrode part is determined by subtracting the blank pressure drop in absence of an electrode from the average pressure of both anode and cathode.

The following Examples and Comparative Examples further illustrate the present invention in detail but is not to be construed to limit the scope thereof.

EXAMPLE 1

1.8 Metric counts of spun yarns were spun by using regenerated cellulose fibers of 2.0 denier in filament denier and three of these were twisted together to obtain a twist yarn (thicker yarn 12) of 0.6 metric counts. And, as finer yarns 13, 2.3 metric counts of spun yarns were spun by using the same size of regenerated cellulose fibers. Then, finer yarns 13 as warps and thicker yarns 12 as wefts were woven into plain cloth of 7.9 yarns/cm of the weft density and 1.97 yarns/cm of the weft density, which was heated from room temperature to 270° C. for three hours in inert gas, kept at 270° C. for one hour, then heated to 2000° C. at a rate of temperature rise of 400° C. per hour and kept at 2000° C. for 30 min. to carbonize the cloth. After cooling, textile fabric of carbon fibers was obtained. Then, this textile fabric was heated to 700° C. in air, kept at that temperature for 4 min. to subject it to oxidation to obtain woven cloth 11 of Example 1. The cloth had 352 g/m$^2$ of weight and 2.2 mm in thickness. The yarn count of the thicker yarns 12 used for this woven cloth after the oxidation treatment was 1.3, and that of the finer yarns 13 was 4.7. The above woven cloth was cut into 2 rectangular test pieces having 10 cm in length toward the thicker yarn 12 direction and 1 cm in length toward the finer yarn 13 direction and they were mounted inside a spacer 6 having 2 mm in thickness with a silicone rubber adhesive so that the thicker yarns 12 were disposed in the flow direction to test electrode performance. As the results, the cell conductivity was 0.625 S cm$^{-2}$, the current efficiency was 97.6% and the pressure drop was 7 mmHg. <002> spacing by X-ray analysis was 3.61 Å and O/C ratio by ESCA was 9.8%.

EXAMPLE 2

Knitted cloth as shown in FIG. 3 having 1.97 yarns/cm of the warp density and 7.9 yarns/cm of the weft density was woven by using the same thicker spun yarns as the warps and the finer yarns as the wefts as those in Example 1. The cloth was treated according to the same manner as in Example 1 to obtained the knitted cloth 11 of Example 2. In this case, the cell conductivity was 0.667 S cm$^{-2}$, the current efficiency was 97.7% and the pressure drop was 7 mmHg. The cloth was better than that of Example 1 because the former had better non-fraying property as compared with the latter.

COMPARATIVE EXAMPLE 1

16.9 metric counts of spun yarns were spun by using regenerated cellulose fibers of 2.0 denier in filament denier and three of these were twisted together into a twisted yarn of 5.6 metric counts. The twisted yarns were used as both warps and wefts to weave into tussore having 17.7 yarns/cm of the warp density and 11.4 yarns/cm of the weft density. This was carbonized and treated by oxidation according to the same manner as described in Example 1 to obtain a woven cloth of Comparative Example 1. This woven cloth of Comparative Example 1 was 1.2 mm in thickness, 370 g/cm$^2$ of weight and 12 metric counts of the yarn count. This woven cloth of Comparative Example 1 was cut into a piece having 10 cm in length toward the warp direction and 1 cm in length toward the weft direction and mounted on a spacer 6 having 1 mm in thickness. In this case, the cell conductivity was 0.53 S cm$^{-2}$, the current efficiency was 97.5% and the pressure drop was 342 mmHg.

That is, textile fabric for the electrode of Example 1 or 2 had excellent electrochemical properties and remarkably lower pressure drop in comparison with the fabric of Comparative Example 1. The pressure drop in the electrode of Example 1 or 2 was about one-fiftieth of that of Comparative Example 1.

EXAMPLE 3

Three of the twisted yarns of 5.6 metric counts used in Comparative Example 1 were further twisted together to obtain a twisted yarn of 1.9 metric counts. Plane woven cloth having 4.7 yarns/cm in the weft density and 7.9 yarns/cm in the warp density was woven by using the twisted yarns of 1.9 metric counts as the wefts and the twisted yarns of 5.6 metric counts as the warps. The cloth was carbonized and treated by oxidation according to the same manner as described in Example 1 to obtain carbonized woven cloth having 1.63 mm in thickness, 4.02 metric counts of the wefts and 11.8 metric counts of the warps. The cloth was carefully cut into a piece having 10 cm in length toward the thicker yarn direction and 1 cm in length toward the finer yarn direction to effect the electrode test. As the results, the cell conductivity was 0.611 S cm$^{-2}$ and the current efficiency was 97.2%. The pressure drop was 42 mmHg and it was about one-eighth of the pressure drop in Comparative Example 1.

What is claimed is:

1. An electrode for a flow-through type electrolytic cell which comprises:

a frame spacer formed with a plate made of an insulating material and textile fabric made of carbon fibers disposed in the inner space of the spacer;

said spacer and said textile fabric being held between a membrane and a bipolar plate so that an electrolytic solution flows through the texture of the above textile fabric in one direction or in the reverse direction;

said textile fabric being composed of thicker yarns of not finer than 5 metric counts and yarns finer than said thicker yarns which are disposed so as to cross said thicker yarns; and said textile fabric being fixed so that the thicker yarns are arranged adjacent to one another and substantially in parallel with the flow direction of a reactant, so as to form split paths between said adjacent thicker yarns.

2. The electrode according to claim 1, wherein the thicker yarns have 0.1 to 3.0 metric counts.

3. The electrode according to claim 1, wherein the yarns finer than said thicker yarns are disposed so as to cross said thicker yarns at right angles.

* * * * *